United States Patent [19]

Michael

[11] 4,372,240

[45] Feb. 8, 1983

[54] SURFACE SHIP HAVING IMPROVED SPEED AND MANEUVERABILITY

[76] Inventor: Farid Y. Michael, Orange, Tex.

[21] Appl. No.: 171,575

[22] Filed: Jul. 23, 1980

[51] Int. Cl.[3] ..... B63B 1/00

[52] U.S. Cl. ..... 114/56

[58] Field of Search ..... 114/56, 57, 61, 67 R

[56] References Cited

U.S. PATENT DOCUMENTS

| | | | |
|---|---|---|---|
| 1,436,902 | 11/1922 | Perley | 114/56 |
| 2,327,660 | 8/1943 | Napoli | 114/56 |
| 3,063,397 | 11/1962 | Boericke, Jr. | 114/57 |
| 3,447,502 | 6/1969 | Leopold | 114/61 |
| 3,854,435 | 12/1974 | Kinoshita | 114/65 R |

*Primary Examiner*—Sherman D. Basinger
*Assistant Examiner*—Jesús D. Sotelo
*Attorney, Agent, or Firm*—Michael P. Breston

[57] ABSTRACT

The surface ship has a hull comprised of a deck, a bottom, a starboard side and a port side, between the deck and the bottom. The hull has a bow section, a stern section, and a mid-body section between the bow and stern sections.

Each side of the ship has an outwardly protruding top hull and an outwardly-protruding bottom hull. The top and bottom hulls form an open-ended channel therebetween extending throughout the full length of the ship. The side walls of the channel are formed by a flat surface portion in the ship's mid-body section, and by a complex surface in the ship's bow and stern sections. Each complex surface is formed by flat, cylindrical and conical surfaces.

6 Claims, 14 Drawing Figures

FIG. 1.
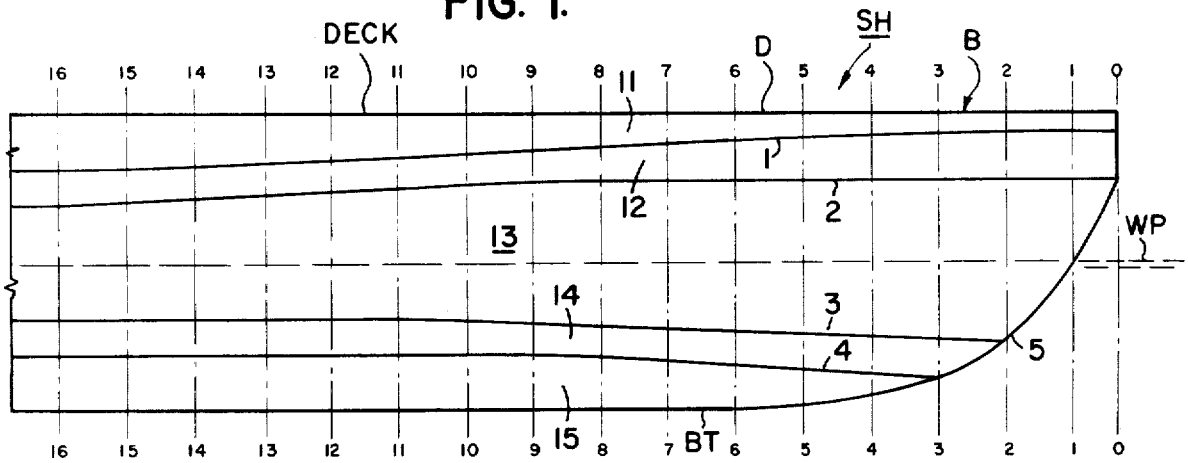
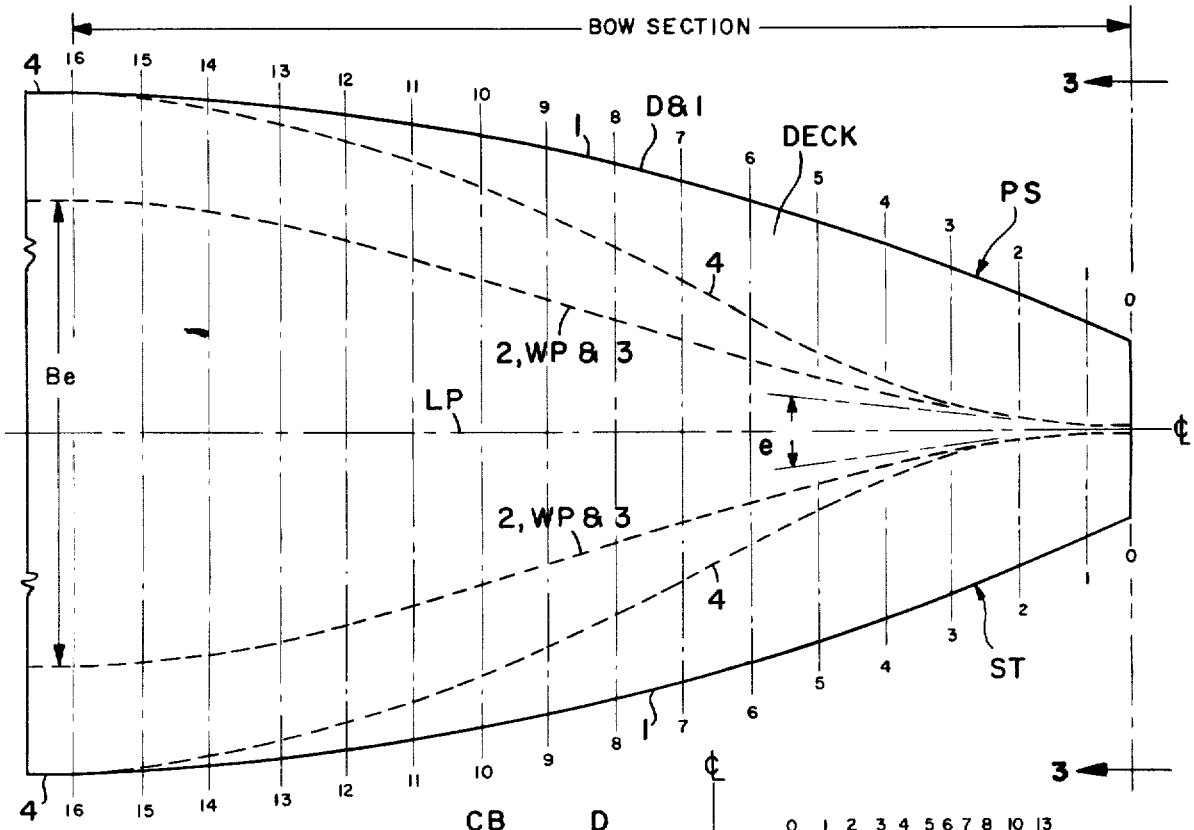
FIG. 2.
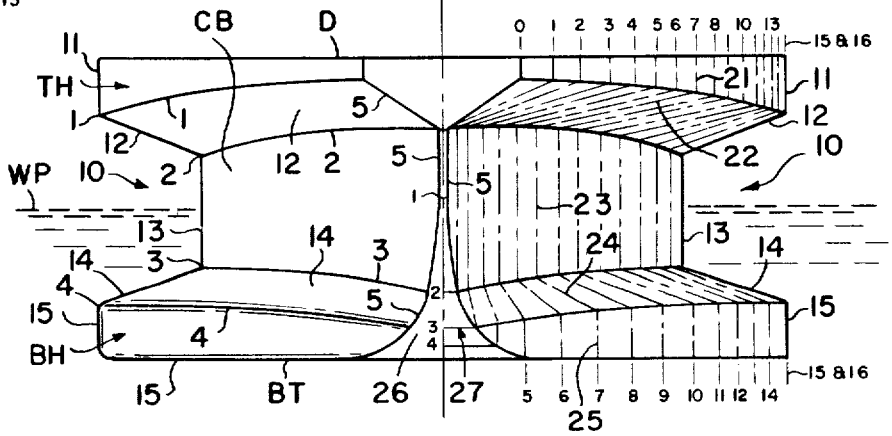
FIG. 3.

SURFACE SHIP HAVING IMPROVED SPEED AND MANEUVERABILITY

BACKGROUND OF THE INVENTION (a) Field of the Invention

This invention relates to the art of designing single hull surface ships such as tankers, bulk cargo carriers, container ships, and other types of commercial and military vessels.

(b) Brief Description of the Prior Art

Various hull designs have been proposed for improving the maneuverability of particular surface ships. For example, a whale capture ship and a tug must be able to turn around within a short radius and also to start and stop very rapidly. In order for a ship to possess adequate maneuverability, it must be able to maintain a given heading with the least movement of the rudders; it must have a rapid and reliable response to the angling of the rudders; and when it is desired to change heading, course and position, in normal operational maneuvers, it must be able to make rapid changes in speed, heading direction, attitude or position, especially as when avoiding collision, clearing an obstacle to navigation, or carrying out emergency evasive tactics.

In my prior U.S. Pat. No. 3,965,837 is described a barge having a reduced rolling motion in response to wave action. The barge is characterized by a close-ended channel having constant, parallel sectional areas from one end of the channel to the other end of the channel, that is, the channel has a uniform cross-sectional area.

My present invention is directed to fast ships and it is a general object of the present invention to provide fast, single-hull surface ships which are characterized by (1) a substantially reduced water plane, resulting in a substantially reduced angle of entrance at the bow and a relatively full transom at the stern, (2) a reduced self-generated wave profile, (3) a substantially reduced requirement for engine horsepower, especially at higher speeds, when compared to similar conventional ships, and (4) a substantially reduced water resistance both to longitudinal and transverse ship movements, thus improving the ship's maneuverability characteristics.

It is a further object of the present invention to reduce torsional and longitudinal bending moments normally produced by wave actions.

It is another object of the present invention to provide a hull having an improved strength-to-weight ratio.

SUMMARY OF THE INVENTION

The surface ship has a hull comprised of a deck, a bottom, a starboard side and a port side, between the deck and the bottom. The hull has a bow section, a stern section, and a mid-body section between the bow and stern sections.

Each side of the ship has an outwardly protruding top hull and an outwardly-protruding bottom hull. The top and bottom hulls form an open-ended channel therebetween extending throughout the full length of the ship. Each channel has a bottom surface, an underside surface which extends outwardly and upwardly, and a top surface which extends outwardly and downwardly. The underside and top surfaces are formed by a flat surface portion in the ship's mid-body section, and by a complex surface in the ship's bow and stern sections.

Each complex surface is formed by flat, cylindrical and conical surfaces.

BRIEF DESCRIPTION OF THE DRAWINGS

FIG. 1 is a side view in elevation of the bow section and of a portion of the mid-body section of the ship in accordance with the present invention;

FIG. 2 is a plan projection of the chine lines of the bow section;

FIG. 3 is a front view of the bow section taken on line 3—3 of FIG. 2, showing contour lines of the port side only;

DESCRIPTION OF A PREFERRED EMBODIMENT

Figure 4:
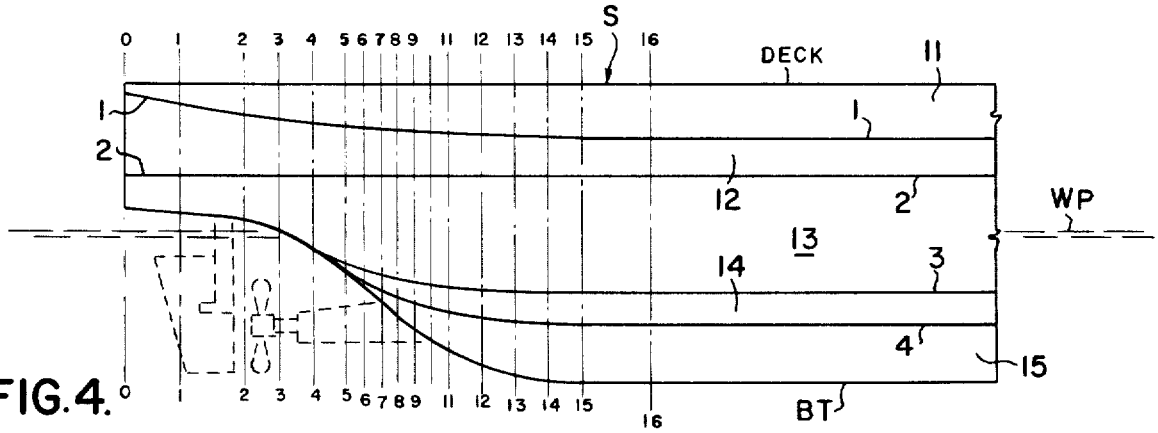
FIG. 4 is a side view in elevation of the stern section and of a portion of the mid-body section.
Figure 5:
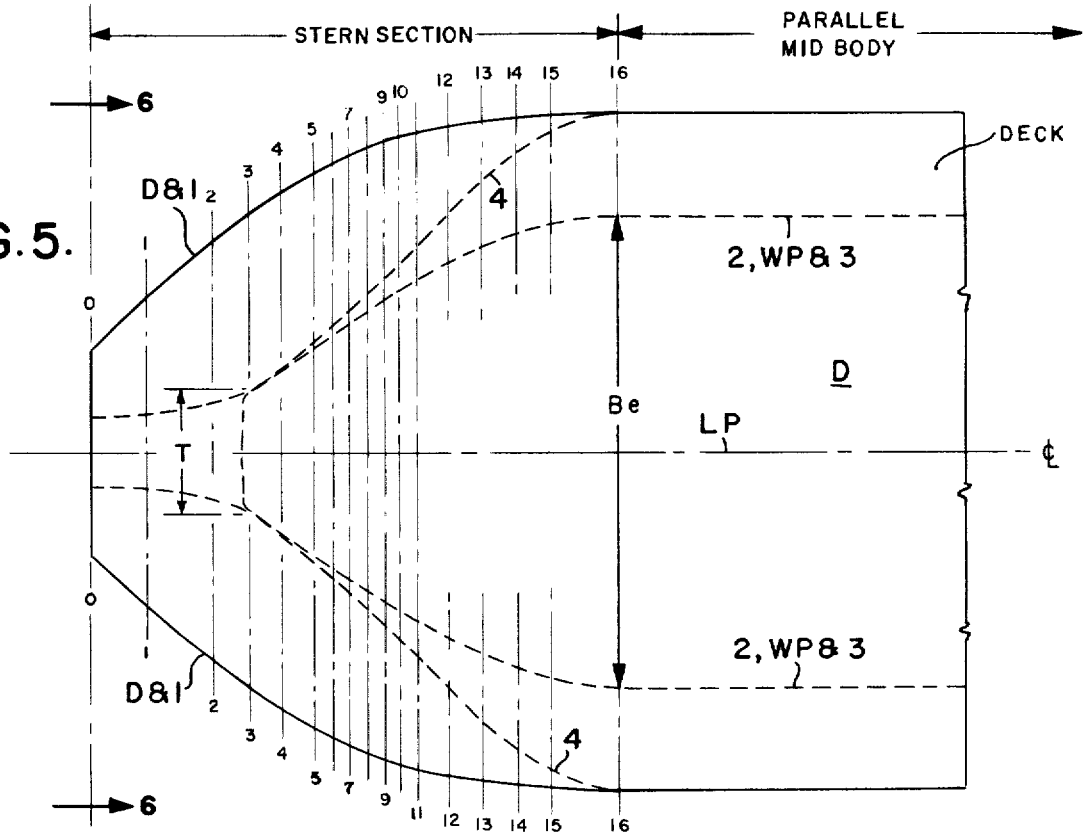
FIG. 5 is a plan projection of the chine lines of the stern section.
Figure 6:
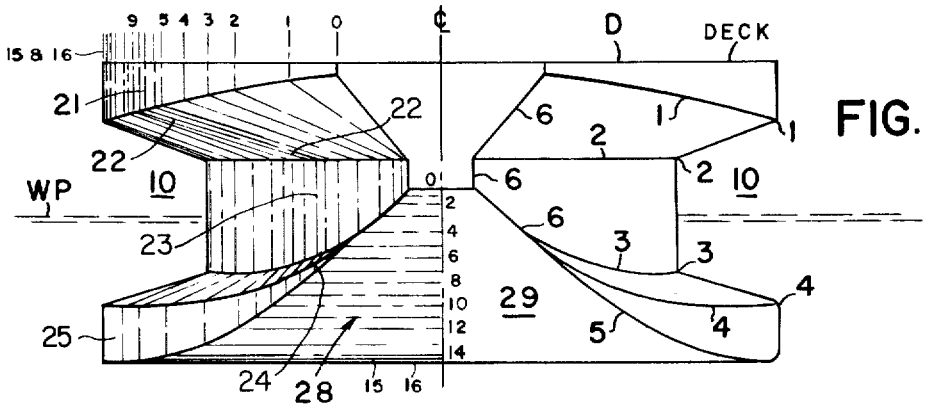
FIG. 6 is a rear view of the stern section taken on line 6—6 of FIG. 5, showing contour lines of the port side only.
Figure 7:
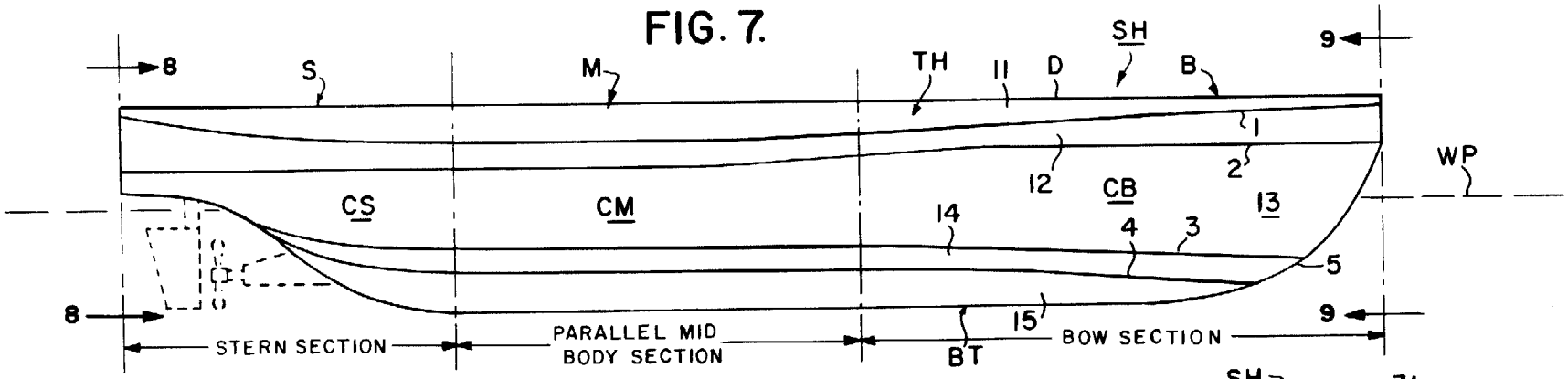
FIG. 7 is an elevational side view of the starboard of the entire ship.

FIGS. 1–9 depict a ship SH having a bow section B, a stern section S, a mid-body section M, a deck D, a bottom BT, a starboard side portion ST, and a port side portion PS. Below the deck of the ship are contained various storage areas and living quarters depending on the function of the ship SH. Since the starboard and port side portions are symmetrical, the description of the port side is also applicable to the starboard side, and to simplify the description only the port side will be described in detail.

The description of the ship will be facilitated with the aid of "chine" lines and "contour" lines. A chine line is a line at which two non-planar surfaces intersect. A contour line is a line obtained by making a sectional cut in a plane transversally to the longitudinal plane LP of the ship. The chine and contour lines are commonly used in designing hulls and will be understood by those skilled in the art.

In accordance with the present invention, in the starboard and port side portions of the ship there is provided a longitudinal channel 10 having a bottom recessed wall surface 13 which extends throughout the entire longitudinal length of the ship from the bow end to the stern end. Channel 10 has a bow section CB, a mid-body section CM, and a stern section CS.

Channel 10 lies between an outwardly-protruding top hull portion TH and an outwardly-protruding bottom hull portion BH. These protruding top and bottom hull portions TH and BH, together with their respective channels 10, constitute the port and starboard sides of the ship.

Top hull portion TH is defined starting from the outer parts of the ship deck D by (1) a vertical sidewall 11, and (2) an underwall 12 having an outer end connected to sidewall 11 and forming therewith chine line 1 and an inner end connected to the vertical bottom surface 13 of channel 10 and forming therewith chine line 2. Bottom hull portion BH is defined, starting from the outer parts of the ship bottom BT, by a sidewall 15 and a top surface 14 having an inner end connected to the bottom surface 13 and an outer end connected to the sidewall 15 and forming therewith chine line 4. Top surface 14 and the bottom surface 13 of channel 10 form therebetween chine line 3. The ends of chine lines 1–4 between the deck D and bottom BT form (1) chine lines 5 at the bow B, and (2) chine lines 6 at the stern S.

Channel 10 has an open ended mouth extending between chine lines 1 and 4. The bottom surface 13 of channel 10 extends between chine lines 2 and 3. The top water surface of the body of water intersects the recessed wall surface 13 of channel 10 at a plane WP, thereby causing a quantity of water to be disposed above the channel's bottom side wall surface 14. Desirably, the water plane WP will intersect the channel's recessed wall surface 13 at a vertical level which provides sufficient draft for the ship SH, as well as sufficient spacing below the deck D to minimize battering by the waves of the channel's upper side wall 12.

As a direct consequence of the open-ended channels 10, as above described, the effective water plane area WP, at the waterline of the ship, is appreciably diminished compared to the water plane area of a conventional ship having no open-ended channels 10 in the sides thereof.

The mid-body section M of the ship (FIG. 7) has constant, parallel, sectional contour lines (not shown).

Sectional contour lines 1–16 are shown in the bow and stern sections of the ship SH. It will be apparent from these contour lines 1–16 that the surfaces 11, 13 and 15 are surfaces having a single direction of curvature, that is, cylindrical surfaces. Any transverse section of surfaces 11, 13 and 15 will provide a straight vertical line. The underwall 12 and the top surface 14, which constitute the side walls of channel 10, are complex surfaces which are formed by a combination of flat (in the mid-body section M) and of flat, cylindrical and conical surfaces (in the bow and stern sections B and S). Any transverse section of such a complex cylindrical-conical surface is a slanted straight line.

While, as previously mentioned, the mid-body section M has constant, sectional contour lines between the bow section and the stern sections, the bow section is preferably distinct from the stern section.

Because of symmetry of the bow and stern sections relative to the longitudinal plane LP, only half of the contour lines will be described, the other half of the contour lines being exactly the same.

Bow Section

A typical description of one contour line, say contour line C-7 is as follows: a straight vertical line 21 between deck D and chine line 1, a forwardly-and-downwardly slanted straight line 22 between chine lines 1 and 2, a straight vertical line 23 between chine lines 2 and 3, a rearwardly-and-downwardly slanted straight line 24 between chine lines 3 and 4, and a straight vertical line 25 between chine line 4 and the hull bottom BT.

The transverse end surface 26 of the bow section, delineated between chine lines 5, is a vertical surface which smoothly bends inwardly in a horn-like fashion toward the ship's bottom BT. Accordingly, the contour lines on surface 26 are horizontal lines 27 which gradually increase in length from the near deck to the bottom of the ship.

Stern Section

A typical description of one contour line, say contour line C-7, is as follows: a straight vertical line 21 between the deck D and chine line 1, a slanted rearwardly-and-downwardly straight line 22 between chine lines 1 and 2, a straight vertical line 23 between chine lines 2 and 3, a slanted outwardly-and-downwardly straight line 24 between chine lines 3 and 4, and a straight vertical line 25 between chine line 4 and the hull bottom BT.

The transverse end surface 29 of the stern section, delineated between chine lines 6, is a vertical surface which smoothly bends in a horn-like fashion inwardly toward the ship's bottom BT. Accordingly, the contour lines on surface 29 are horizontal lines 28 which gradually increase in length from near deck D to the ship's bottom BT.

Thus, the sectional contour lines 1–16 of the stern section S are similar in shape to the contour lines 1–16 of the bow section B starting from the mid-body section M and moving toward the ends of the ship. The main distinguishing features between the contour lines of the bow and stern sections are the horizontal contour lines on surfaces 26 and 29: horizontal contour lines 27 on surface 26 have a shorter length than their corresponding horizontal contour lines 28 on surface 29.

The power required to propel a ship through water depends to a large extent upon the resistance offered by the water, the air surrounding the ship, the efficiency of the propellers, the hull's design, and the efficiency of the power transmission and train. In rough seas, there is produced increased water resistance, and the propeller must operate under less favorable conditions.

The resistance of the ship to steady, straight line motion can be subdivided into pressure or normal resistance, separation and dynamic drag, and wave-making drag resulting from a summation of pressure differentials due to the peaks and valleys of the waves formed at the sides of the ship. The total hull resistance is, therefore, considerable and quite complex.

The novel design of the present invention appreciably reduces and minimizes the hull's resistance and, therefore, the power required particularly at high speeds, or less power is required to drive the same ship for a given speed.

The ship SH of the present invention has a smaller self-generated wave (FIG. 10) when it is moving ahead, thereby reducing the wave-making resistance of the ship, as compared to the self-generated wave (FIG. 11) of a conventional ship.

Figure 10:
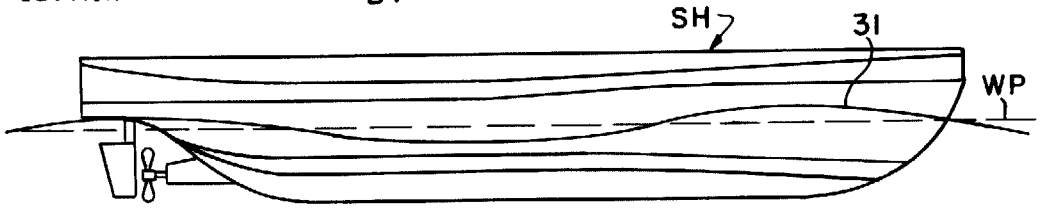
FIG. 10 shows the dynamic wave generated at high speeds with the hull of the present invention in normal operating waters.
Figure 11:
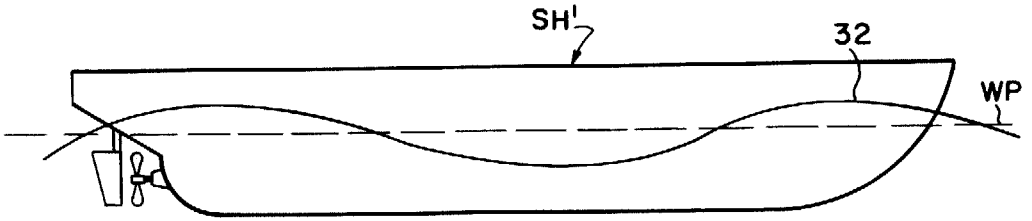
FIG. 11 shows the dynamic wave generated at high speeds with a comparable size but conventional ship.
Figure 8:
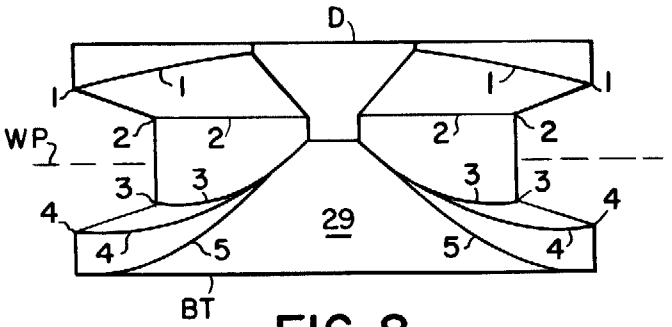
FIG. 8 is a rear view of the stern section, without the contour lines, but with the transverse projections of the chine lines.
Figure 9:
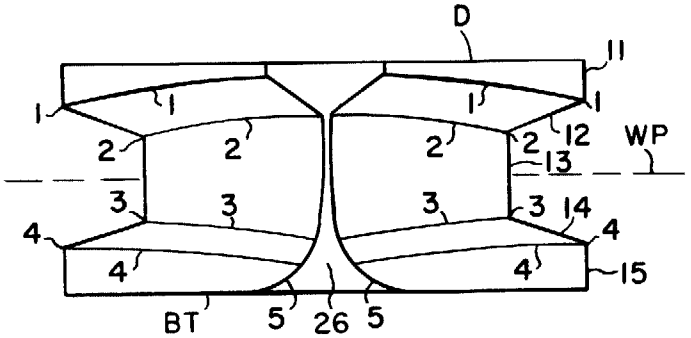
FIG. 9 is a front view of the bow section, without the contour lines, but with the transverse projections of the chine lines.

The reduction in the dynamic drag or wave-making resistance can be appreciated from a comparison of FIGS. 10 and 11. It will be noted that the amplitude of the wave profile 31 (FIG. 10) at high speeds generated with the ship SH of the present invention is considerably lower than the wave profile 32 generated by a conventional comparable ship SH' (FIG. 11), both navigating under comparable dynamic sea conditions.

As a direct consequence of the design of the bow section B of the ship SH of the present invention, the water plane WP (FIG. 2) at the bow section has a relatively small angle of entrance "e" and a relatively narrow breath "Be"

The combined effects of the water plane WP and of the sloping side walls 14 of the channel 10 result in a substantial reduction in dynamic drag, or wave-making resistance. This reduction in dynamic drag is translated into a considerable reduction in the horsepower required to propel the ship SH at higher speeds.

Similarly, at the stern section S of the ship SH, there is obtained a water plane WP (FIG. 5) which is characterized by a relatively full exit transom T. This water plane shape together with the complex sloping top surfaces 12 result in a substantial reduction in the self-generated wave, when the ship is advancing ahead, which produces a corresponding substantial reduction in the wave-making resistance, particularly at higher speeds.

Figure 12:
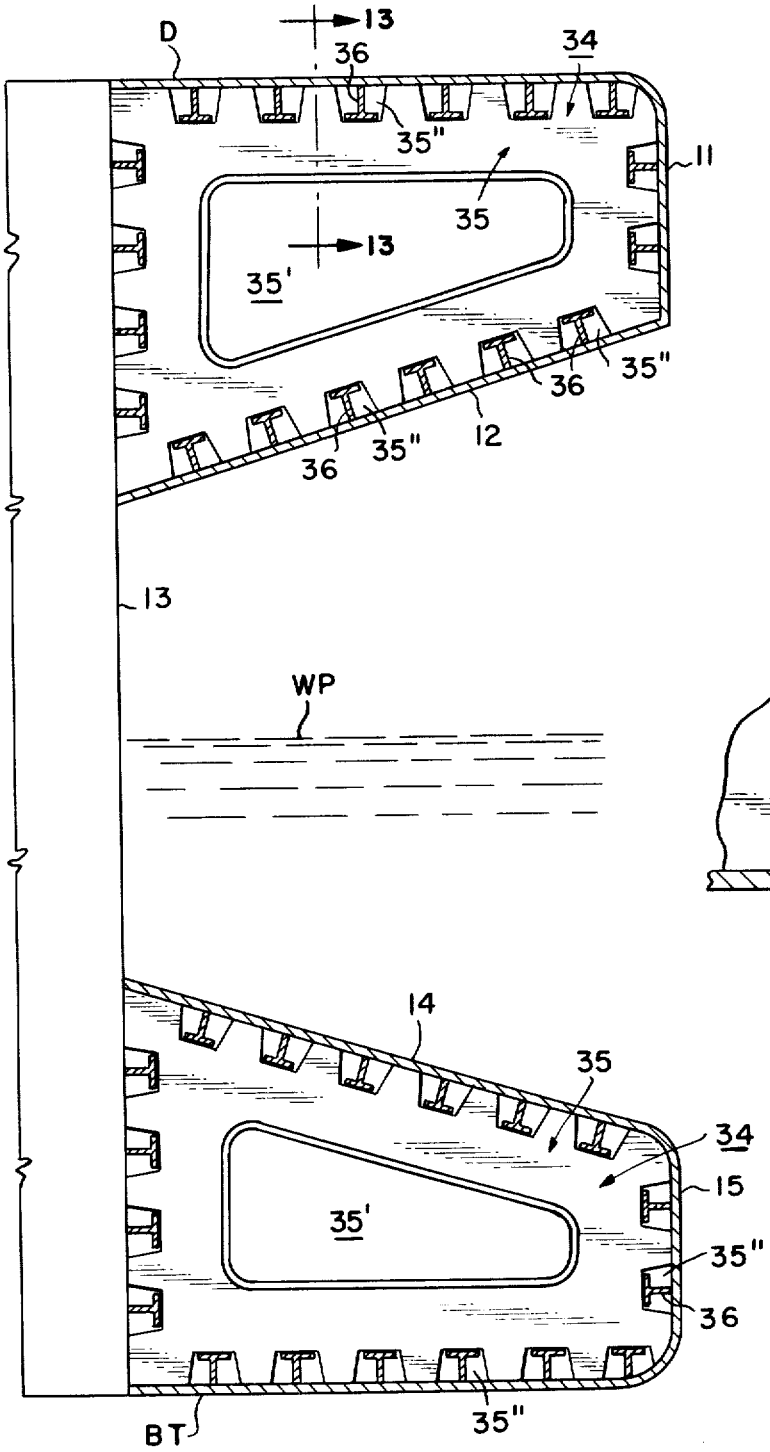
FIG. 12 is a transverse sectional view of the top and bottom hulls and of the channel therebetween, showing details of construction of the ship of the top and bottom hulls in the ship of the present invention.
Figure 13:
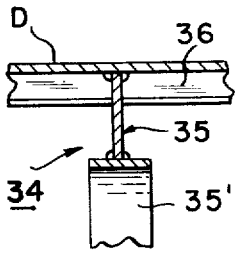
FIG. 13 is a fragmentary sectional view taken on line 13—13 of FIG. 12.
Figure 14:
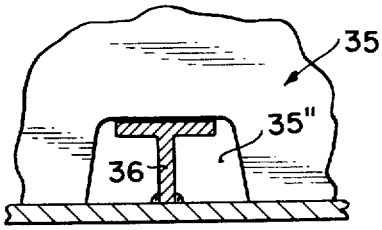
FIG. 14 is an enlarged sectional view of a single structural member shown in FIG. 12.

With reference to FIGS. 12–14 there are shown reinforcing structural members in the top and bottom hulls. Each hull has a structure 34 comprising spaced vertical plates 35, each having a large opening 35' approximately in the center thereof and openings 35" at the outer edge thereof through which the T-bars 36 extend throughout the entire length of the ship SH. The T-bars 36 are welded to the inner wall of the hull.

Structure 34, being further removed from the structural neutral axis than the bottom wall 13 of channel 10, provides increased resistance to horizontal and vertical bending moments and to torsional loading. Accordingly, the hull of this ship has an appreciably increased strength-to-weight ratio and a reduced overall weight.

What is claimed is:

1. A fast single hull surface ship having a top deck, a bottom, a starboard side, and a port side, said sides being symmetrical relative to a vertical longitudinal plane of symmetry;

said ship defining a bow section, a stern section, and a mid-body section;

said bow and stern sections each having a transverse end surface;

said starboard and port sides, each having an outwardly protruding upper side hull, an outwardly protruding lower side hull, and a channel between said upper and lower side hulls, each of said upper and lower side hulls having in the bow and stern sections an external cylindrical side wall;

in the bow and stern sections each of said channels having a recessed cylindrical wall which spans without interruption from the transverse end surface of the bow section up to the transverse end surface of the stern section, an upper inwardly-sloping side wall, and a lower outwardly-sloping side wall, the inwardly-sloping side wall having a conical portion whose area increases toward the end surface of the stern section, and whose area increases toward the bow section, and the outwardly-sloping side wall of said channel having a conical surface of reduced surface area up to the transverse end surface of the bow section and having a conical surface of reduced surface area up to the transverse end surface of the stern section.

2. The ship of claim 1, wherein the end surface of the bow section has a vertical planar portion between said outwardly-protruding upper side hulls of said starboard and port sides, a narrow planar portion gently inwardly tapering between the recessed walls of the channels in the starboard and port sides, and an inwardly tapering curved portion of increasing width between the lower side hulls; and the end surface of the stern section has a vertical planar portion of decreasing width between the top side hulls, and a downwardly tapering curved surface of increased width extending to the bottom of the ship.

3. A ship having a bow section, a stern section, a mid-body section, a deck, a bottom, a starboard side, and a port side;

the starboard and port sides of the ship each being substantially symmetrical relative to a vertical longitudinal plane of symmetry, and each having an outwardly-protruding top hull portion, an outwardly-protruding bottom hull portion, and a longitudinal channel therebetween;

the longitudinal channel has a recessed bottom wall which extends throughout the entire longitudinal length of the ship from the bow end to the stern end;

the outwardly-protruding top hull portion has a first side wall and an underwall, the outer end of the underwall is connected to the first side wall and forms therewith a first chine line and the inner end of the underwall is connected to the recessed bottom wall and forms therewith a second chine line;

the outwardly-protruding bottom hull portion has a second side wall and a top wall, the inner end of the top wall is connected to the recessed bottom wall, the outer end of the top wall is connected to the second side wall and forms therewith a fourth chine line, and the recessed bottom wall and the top wall form therebetween a third chine line;

the ends of the first, second, third and fourth chine lines form at the bow between the deck and the bottom of the ship a pair of fifth chine lines and form at the stern between the deck and the bottom of the ship a pair of sixth chine lines; and each one of the recessed bottom wall, the first side wall, the second side wall, the underwall, and the top wall has flat surfaces in the mid-body section and complex curvilinear surfaces in the bow and stern sections.

4. The ship of claim 3, wherein the longitudinal channel has an open-ended mouth extending between the first and fourth chine lines, the recessed bottom wall extends between the second and third chine lines, and the mid-body section of the ship has substantially constant, parallel, transverse contour lines.

5. The ship of claim 4, wherein:

each transverse contour line of the bow section has a straight line between the deck and the first chine line, a forwardly-and-downwardly slanted straight line between the first and second chine lines, a straight line between the second and third chine lines, a rearwardly-and-downwardly slanted straight line between the third and fourth chine lines, and a straight line between the fourth chine line and the hull's bottom;

the bow section contains between the pair of fifth chine lines a first end surface which smoothly bends inwardly in a horn-like fashion toward the ship's bottom;

each transverse contour line of the stern section has a straight line between the deck and the first chine line, a rearwardly-and-downwardly slanted straight line between the first and second chine lines, a straight line between the second and third chine lines, an outwardly-and-downwardly slanted straight line between the third and fourth chine lines, and a straight line between the fourth chine line and the hull's bottom;

the stern section contains between the pair of sixth chine lines a second end surface which smoothly bends in a horn-like fashion inwardly toward the ship's bottom; and each one of the first and second end surfaces has substantially-constant, parallel, horizontal contour lines, the horizontal contour lines on the first end surface have a shorter length than the horizontal contour lines on the second end surface.

6. The ship of claim 3, wherein said complex curvilinear surface of the recessed bottom wall and of the first and second side walls consist of a combination of flat, cylindrical, and conical surfaces in the bow and stern sections, and the complex curvilinear surfaces of the underwall and of the top wall consist of a combination of flat, cylindrical, and conical surfaces in the bow and stern sections.

* * * * *